US006588209B2

(12) United States Patent
Kleibrink

(10) Patent No.: US 6,588,209 B2
(45) Date of Patent: Jul. 8, 2003

(54) METHOD AND APPARATUS FOR OPTIMIZING THE OIL FLOW INSIDE OF A DIAPHRAGM COMPRESSOR

(76) Inventor: Horst Kleibrink, Heisenbergstr. 16, 45473 Muelheim-Ruhr (DE)

( * ) Notice: Subject to any disclaimer, the term of this patent is extended or adjusted under 35 U.S.C. 154(b) by 0 days.

(21) Appl. No.: 10/004,402

(22) Filed: Nov. 15, 2001

(65) Prior Publication Data

US 2002/0044874 A1 Apr. 18, 2002

(30) Foreign Application Priority Data

Nov. 15, 2000 (DE) ..... 100 56 708

(51) Int. Cl.[7] ..... F15B 7/00
(52) U.S. Cl. ..... 60/591; 417/383
(58) Field of Search ..... 60/591; 417/383, 417/385

(56) References Cited

U.S. PATENT DOCUMENTS 3,402,667 A * 9/1968 Bower ..... 417/385
3,664,770 A * 5/1972 Palmer ..... 417/383
4,621,989 A * 11/1986 Burgert ..... 417/383

FOREIGN PATENT DOCUMENTS

DE 1 132 285 6/1962
DE 1 653 465 11/1971

* cited by examiner

*Primary Examiner*—F. Daniel Lopez
(74) *Attorney, Agent, or Firm*—McCormick, Paulding & Huber LLP

(57) ABSTRACT

Method and apparatus for optimizing the oil flow inside of a diaphragm compressor concerns the previously non-organized oil flow in the head of a diaphragm compressor leading to the previous formation of pockets between the diaphragm and the cover curve, the method and apparatus providing a continuous circulation of oil in the pressure stroke and in the suction stroke which is achieved by means of a valve plate which in the pressure stroke of the piston closes holes in the middle area of the aperture plate automatically and in the suction stroke of the piston again frees those holes automatically.

7 Claims, 2 Drawing Sheets

METHOD AND APPARATUS FOR OPTIMIZING THE OIL FLOW INSIDE OF A DIAPHRAGM COMPRESSOR

CROSS REFERENCE TO RELATED APPLICATION

Applicant hereby claims foreign priority benefits under 35 U.S.C. §119 of German Application No. 100 56 708.8, filed Nov. 15, 2000, the disclosure of which is herein incorporated by reference.

BACKGROUND OF THE INVENTION

The invention concerns a method and an apparatus for optimizing the oil flow inside of a diaphragm compressor.

Diaphragm compressors operate similarly to normal piston compressors but have a separating diaphragm between the gas side and oil side. The oil side is formed as the usual piston-cylinder unit whose working volume and dead volume are filled entirely with oil. On the gas side are gas suction and pressure outlet valves. Through the oscillating movement of the piston the volume displaced by the piston is transmitted to the diaphragm which then in turn takes on the intake, the compression and the expelling of the gas. Since the oil pressure during this entire suction and compressing process corresponds to the gas side, one can also speak here of the working of a piston compressor.

A small difference compared to that of a piston compressor however exists in that in a diaphragm compressor a secondary oil circulation must be installed to compensate for the leakage of oil at the piston. For this purpose a compensation pump, driven by an eccentric cam on the crankshaft, is used. This sprays a small amount of oil into the oil space of the compressor synchronously with each piston stroke. This amount must theoretically be exactly as large as the leakage at the compressor piston. Since this cannot be technically realized, always an injected amount of oil is used which is larger than the leakage. This has in turn the result that with each stroke of the compressor piston somewhat too much oil is found in the oil space, which then at the forward dead point of the diaphragm (=engaging the cover) leads to an uncontrollable oil pressure increase. To avoid this an oil overflow valve must also be provided, which limits the oil pressure at the forward dead point of the piston to a value which is slightly above the maximum pressure of the gas.

The curve formed on the cover for engagement with the diaphragm is shaped according to pure mathematical requirements to allow the diaphragm deformed by the pressure to roll onto the surface of the cover from outwardly toward inwardly. In the broadest sense, in comparison with a piston compressor, the diaphragm operates as the piston and the cover surface as a cylinder. A problem however exists in this in that the progressive sealing effect between the diaphragm and cover does not correspond to that between the piston with its piston rings and the cylinder wall. Local gas pockets can be formed between the diaphragm and the cover surface which not only increase the dead space but also diminish the service life of the diaphragm. These local gas pockets have the effect of sealed islands and cannot be removed even with an overly high oil pressure.

The diaphragm compressors illustrated in Publications DE-AS 1 132 285 and DE-AS 1 653 465 illustrate diaphragm compressors having no construction features from which a desired flow path can be recognized for counteracting the local formation of pockets between the diaphragm and the cover surface.

SUMMARY OF THE INVENTION

The object of the invention is to provide a method and an apparatus whereby the danger of internal pocket formation is strongly diminished.

This object is solved by a valve plate which in the pressure stroke of the piston automatically closes holes in the middle area of the aperture plate, and in the suction stroke of the piston again automatically frees said holes.

An advantageous elaboration of the invention is given in claims.

BRIEF DESCRIPTION OF THE DRAWINGS

An exemplary embodiment of the invention is illustrated in the drawings and is hereinafter described in more detail.

DESCRIPTION OF THE PREFERRED EMBODIMENTS

Figure 1:
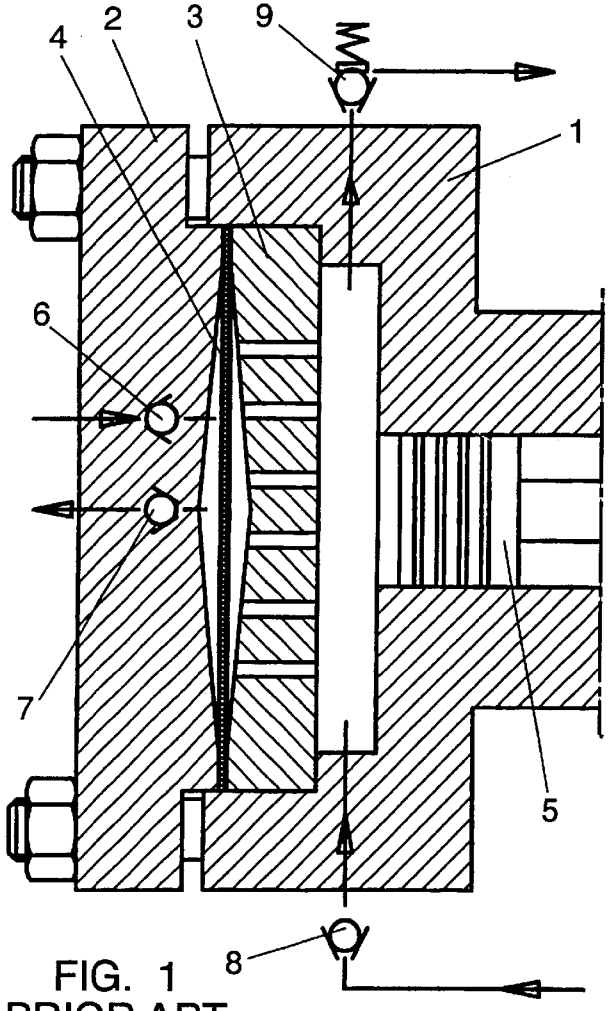
FIG. 1 PRIOR ART
FIG. 1 shows a complete diaphragm head in a construction according to the state of the art.

The main components of a diaphragm compressor according to FIG. 1 include a flange with a cylinder 1, a cover 2, an aperture plate 3, a diaphragm 4, a piston 5, a suction valve 6, a pressure valve 7, a reverse flow check valve 8, and an oil overflow valve 9. The volume designated as the oil space extends between the piston 5 and the diaphragm 4. The volume designated as the gas space extends from the diaphragm 4 to the cover 2. The diaphragm stroke volume is related to the piston stroke volume (surface area x stroke) so that the effectiveness is that of a piston compressor. The diaphragm moves in volume synchronism with the piston, draws in the gas through the suction valve 6, compresses it, and expels it through the pressure valve 7.

The oil leakage at the piston 5 must be compensated by an external pump. For this, a small piston pump driven by an eccentric cam is used, which with each stroke sprays a small amount of oil through the check valve 8 into the oil space. Therefore, since the eccentric cam is located directly on the crankshaft, synchronously with each stroke of the main piston 5 and exactly dosed injection from the compensating pump takes place. Since this injected oil quantity for assured operation must always be larger than the leakage at the piston 5, an oil overflow valve 9 is also necessary, which allows the excess injected quantity of oil to be let out at the forward dead point of the piston 5 and diaphragm 4.

With each forward moving pressure stroke of the piston 5, the piston pushes oil through the holes of the aperture plate 3 toward the diaphragm 4, which then in turn at the forward dead point of the piston comes to lie entirely against the surface of the cover. Despite the mathematical determination of the cover shape, which should promote a rolling of the diaphragm from outwardly toward more inwardly, it repeatedly happens that gas cushions are formed at localized spots between the diaphragm and cover surface. At the same time, the oil flowing through the aperture plate works over the full surface of the diaphragm.

The core of the invention is to effect a deep seated change in the flow relationships which support the rolling of the diaphragm by the oil during the pressure stroke from outwardly toward inwardly, and at the same time to avoid the formation of gas pockets. Also, during the suction stroke of the piston 4, the oil should again reverse flow in a direct way to effect an utmost cooling effect of the oil on the cylinder wall. For realizing these requirements, the flow inside of the oil space must be brought into a circular motion rhythmically with the piston movement. This circulation movement dare not be merely a simple back and forth movement of the oil, but in the pressure stroke the oil, in proceeding from the piston, must first move to the outer zones of the diaphragm, and thereafter to continue with the rolling process must move to the center of the diaphragm. From there, in the suction stroke of the piston, the oil should then immediately thereafter flow again in a direct way through the middle so that the compression heat absorbed primarily in the center during the pressure stroke can be most quickly and effectively transmitted to the cold cylinder wall.

Figure 2:
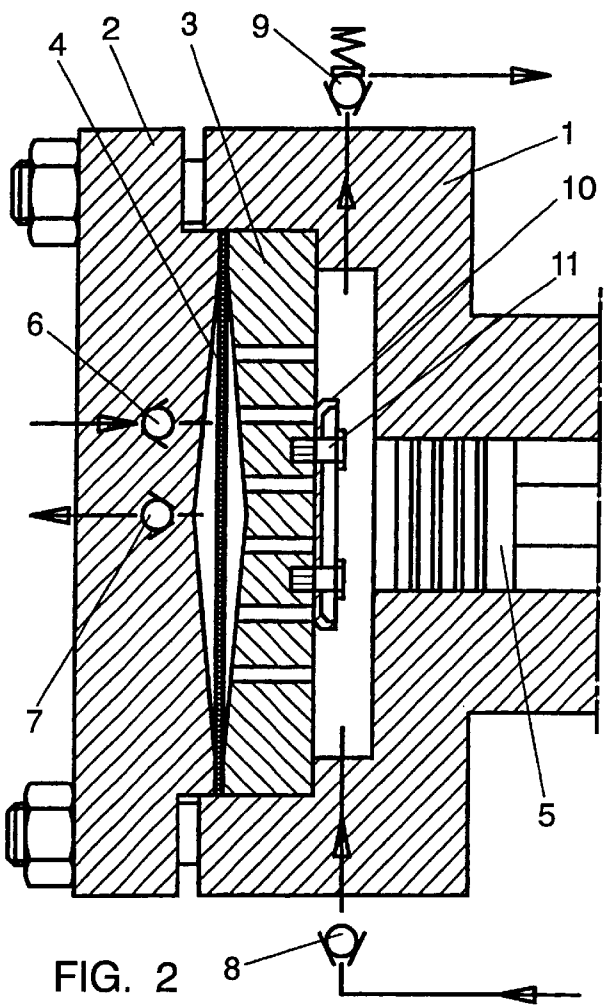
FIG. 2 shows a complete diaphragm head according to FIG. 1 which additionally includes an apparatus according to the invention located inside of the oil space.
Figure 3:
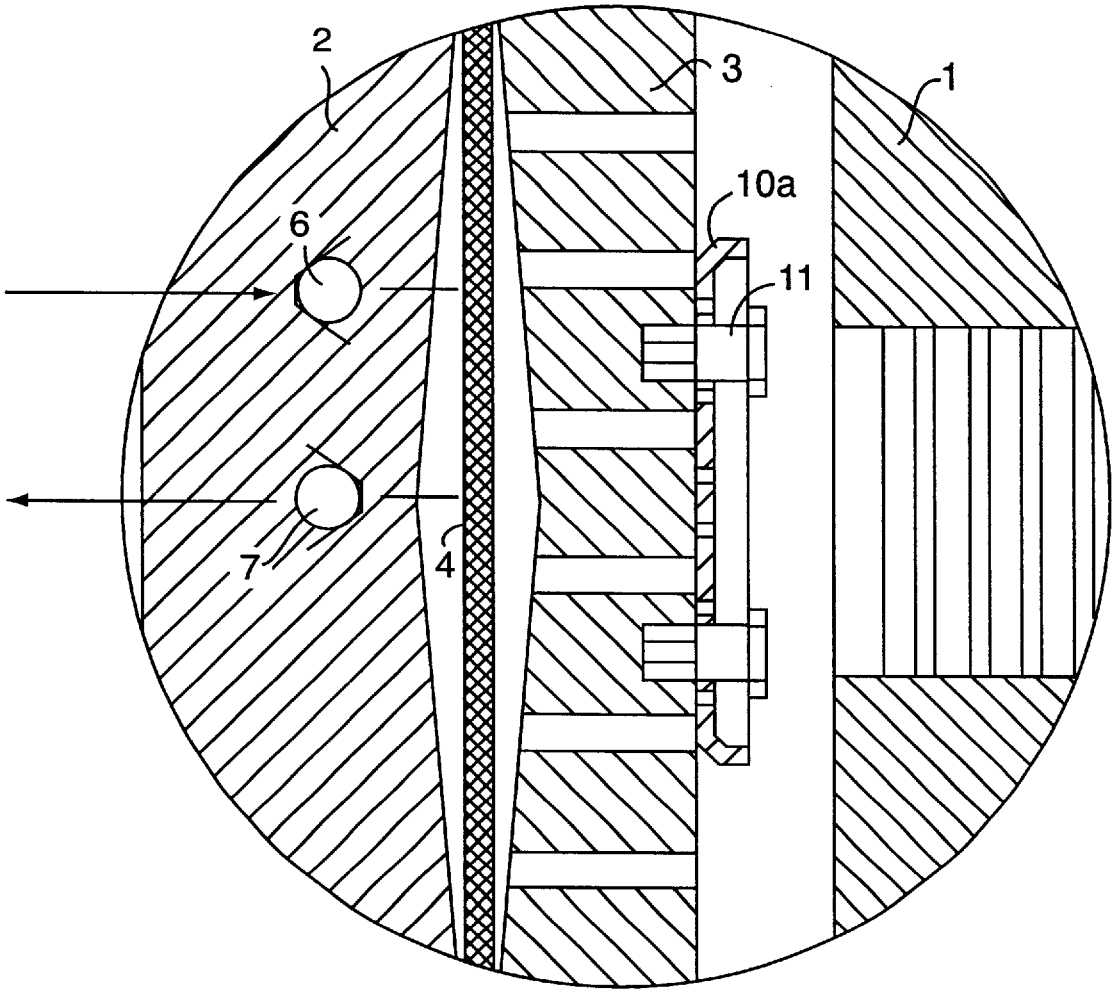
FIG. 3 is a fragmentary view showing an alternate embodiment of the valve plate on the aperture plate.

The apparatus shown in FIG. 2 consists of a valve plate 10 and guides 11 for achieving the aim of creating the aforesaid desired circulation of the oil. In the pressure stroke of the piston 5 the valve plate 10 automatically comes to lie against the aperture plate, by virtue the differential pressure across it, and closes the holes in the middle area of the aperture plate 3. Therefore the oil must choose an outer path through the still free holes, and therefore it arrives first at the outer area of the diaphragm, where it inhibits the formation of gas pockets by promotion of the mathematical rolling-on process. After the resulting engagement of the entire diaphragm with the cover at the end of the pressure stroke the suction stroke begins which, in turn again because of the differential pressure created across the valve plate 10, lifts the valve plate from the aperture plate surface. Therefore, the heated oil in the middle diametrical region can directly follow the piston in the direction toward the cold cylinder wall. FIG. 3 shows an alternate embodiment of the valve plate 10*a* as a sieve plate with a hole pattern which does not agree with the hole pattern of the aperture plate 3 and which during engagement of the valve plate 10*a* with the aperture plate 10 leaves no small free hole cross-sections. The guides 11 for the valve plates 10 or 10*a* are provided with stops for limiting the reciprocating movement of the valve plate.

What is claimed is:

1. An apparatus for optimizing the oil flow inside of a diaphragm compressor, with a diaphragm driven hydraulically by a piston as well as an aperture plate supporting the diaphragm in a suction stroke, characterized by a valve plate which in the pressure stroke of the piston automatically closes the holes in the middle area of the aperture plate without closing the holes elsewhere in the aperture plate and which in the suction stroke of the piston automatically opens the holes in the middle area of the aperture plate.

2. An apparatus for optimizing the oil flow inside of a diaphragm compressor, according to claim 1, characterized by the valve plate being a sheet metal part and by guide elements fastened to the aperture plate which limit the movement of the valve plate.

3. An apparatus for optimizing the oil flow inside of a diaphragm compressor, according to claim 1, characterized in that the valve plate is formed as a sieve plate with a hole pattern which does not agree with the hole pattern of the aperture plate and which upon engagement of the valve plate with the aperture plate leaves existing no free hole cross-sections.

4. An apparatus for optimizing the oil flow inside of a diaphragm compressor, according to claim 1, characterized by guide elements fastened to the aperture plate which limit the movement of the valve plate.

5. An apparatus for optimizing the oil flow inside of a diaphragm compressor, according to claim 1, wherein the valve plate is formed as a sieve plate with a hole pattern which does not register with the hole pattern of the aperture plate.

6. An apparatus for optimizing the oil flow inside of a diaphragm compressor, with a diaphragm driven hydraulically by a piston as well as an aperture plate supporting the diaphragm in a suction stroke, characterized by a valve plate which in the pressure stroke of the piston automatically closes the holes in the middle area of the aperture plate and which in the suction stroke of the piston automatically frees the holes in the middle area of the aperture plate, the valve plate being a sheet metal part and further characterized by guide elements fastened to the aperture plate which limit the movement of the valve plate.

7. An apparatus for optimizing the oil flow inside of a diaphragm compressor, with a diaphragm driven hydraulically by a piston as well as an aperture plate supporting the diaphragm in a suction stroke, characterized by a valve plate which in the pressure stroke of the piston automatically closes the holes in the middle area of the aperture plate and which in the suction stroke of the piston automatically frees the holes in the middle area of the aperture plate, the valve plate being formed as a sieve plate with a hole pattern which does not agree with the hole pattern of the aperture plate, such that upon engagement of the valve plate with the aperture plate the holes in the middle area of the aperture plate are closed.

* * * * *